United States Patent [19]

Gustafsson et al.

[11] 4,454,614

[45] Jun. 19, 1984

[54] VALVE ARRANGEMENT FOR WATER TOILETS

[75] Inventors: John H. Gustafsson, Bromölla; Tord E. H. Fröberg, Kristianstad, both of Sweden

[73] Assignee: Ifo Sanitar AB, Bromolla, Sweden

[21] Appl. No.: 453,547

[22] Filed: Dec. 27, 1982

[30] Foreign Application Priority Data

Jan. 15, 1982 [SE] Sweden ..... 8200222

[51] Int. Cl.[3] ..... E03D 1/36

[52] U.S. Cl. ..... 4/366; 4/356; 4/378; 4/390; 4/397

[58] Field of Search ..... 4/355, 356, 378, 379, 4/390, 391, 395, 396, 397, 405, 324

[56] References Cited

U.S. PATENT DOCUMENTS

| | | | |
|---|---|---|---|
| 1,188,089 | 6/1916 | Mauer | 4/355 |
| 1,722,200 | 7/1929 | Chadwick | 4/356 |
| 3,758,892 | 9/1973 | Mendez | 4/355 |
| 4,011,605 | 3/1977 | Karlsson et al. | 4/366 |
| 4,185,339 | 1/1980 | Morales | 4/378 |

FOREIGN PATENT DOCUMENTS

| | | | |
|---|---|---|---|
| 2911592 | 9/1979 | Fed. Rep. of Germany | 4/355 |

*Primary Examiner*—Henry K. Artis

*Attorney, Agent, or Firm*—Sughrue, Mion, Zinn, Macpeak and Seas

[57] ABSTRACT

A water toilet has a valve arrangement of the integrated type, i.e. the float and all valves form a unit which in its mounted position is connected to the outlet pipe of the flush water container. According to the invention the unit is loosely connected to said pipe and mechanically retained at its top end by means cooperating with the inner surface of the top portion of the water container wall.

4 Claims, 1 Drawing Figure

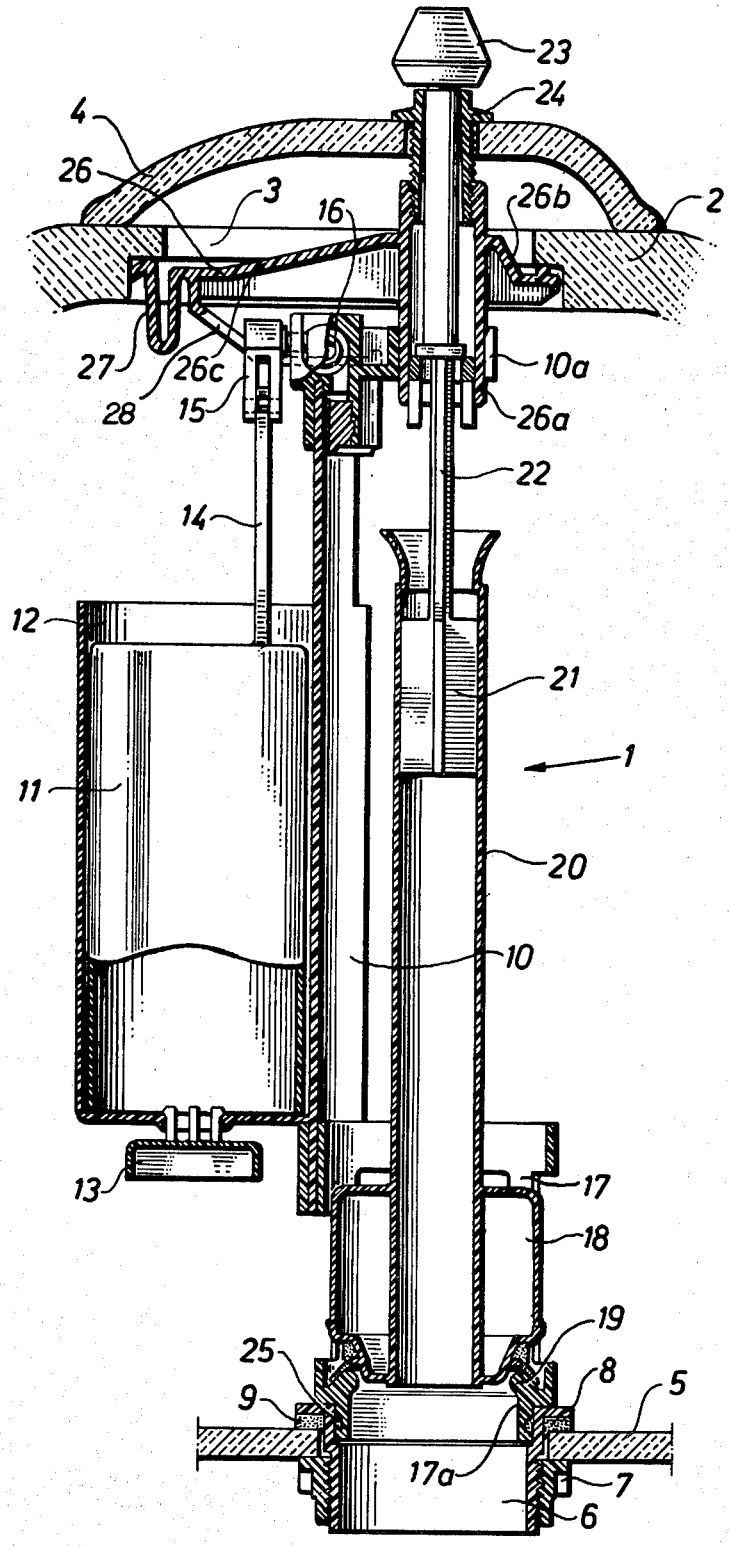
23
24
4
26
3
16
26b
2
27
26c
28
15
10a
26a
22
14
12
21
1
11
20
10
13
17
18
19
25
8
5
9
17a
7
6

VALVE ARRANGEMENT FOR WATER TOILETS

The present invention relates to a valve arrangement to be used in water toilets. Its various components, which form a conveniently mountable and detachable unit, comprise a water inlet valve, a flush valve and means for connecting the unit to the outlet of the flush water container of the toilet.

In prior art arrangements of the type above defined the means retaining the unit in its mounted position are located at the lower end of the unit, i.e. at the flush water outlet. The flush water outlet pipe generally has an annular flange which retains the pipe by clamping the container bottom wall between itself and a nut engaging threads on the pipe. A common way of securing the above-mentioned unit is to provide that flange with hooks which can be received in recesses in the lowermost portion of the unit, generally shaped like a collar surrounded by the top end of the sewer pipe. Such a solution has several drawbacks the most important of which are as follows. Due to the location of the connecting means at the bottom of the container it is difficult both to observe them through the lid opening at the top of the container and to reach them for the purpose of establishing or releasing the locking engagement. A third disadvantage is that they are permanently surrounded by the flush water in the container and for that reason subjected to calcium deposits from the water. When such deposits have been formed release of the unit is further complicated. The reason why the retaining means have always been located at the bottom end of the unit is believed to be the prejudice that the retaining force must be applied at the water oulet connection. The present invention is based on the realization that this belief actually is a prejudice and that it is possible to eliminate all of the drawbacks above referred to by giving the retaining means a different location. According to the main characteristic of the invention these means are instead located at the top end of the unit where they cooperate with the inner wall of that portion of the container which defines the aperture covered by the container lid.

One embodiment of the invention will now be described with reference to the drawing which is an elevational cross-section through the valve arrangement and through adjacent portions of the flush water container bottom and top as seen from the one end wall of the container.

Reference numeral 1 designates the integral unit 1 mounted inside the flush water container of a water toilet. The top wall 2 of the container has an opening 3, normally covered by a lid 4. In the container bottom 5 there is a hole to which the water outlet 6 is connected. The connecting and sealing means comprise a nut ring 7, a flange 8 extending radially outwards from the top end of outlet pipe 6 and a sealing ring 9 clamped between flange 8 and container bottom 5.

Unit 1 has a frame 10 supporting its various components. Those are constituted by a float 11 inside a float casing 12 which is open at its top end and at its lower end has a non-return valve 13. Float 11 carries an upwardly directed control rod 14 which via a link 15 controls the water inlet valve 16 of the arrangement.

The lowermost portion 17 of frame 10 forms a sleeve surrounding the valve body 18 of the outlet valve. Body 18 cooperates with a valve seat 19 located adjacent the upper orifice of outlet pipe 6. Valve body 18 is secured to a tube 20 surrounding a piston 21 which, when engaging a collar surface inside tube 20, raises tube 20 and valve body 18 in response to an upwardly directed movement of a lift rod 22 the top end of which has a control knob 23 and which penetrates a sleeve 24 mounted in a hole in lid 4.

To the extent it has sofar been described the arrangement illustrated is previously known. However, according to the present invention sleeve 17 does at its bottom end have a narrower portion **17*a* surrounded by outlet pipe 6, and O ring 25 providing sealing between these two parts. It should be noted that the connection between unit 1 and the outlet pipe 6 does only exhibit this sealing function, there is no mechanical retaining function. According to the invention the means securing unit 1 in a conveniently detachable mounted position are instead located at the top end of the unit. According to the embodiment here illustrated those means comprise a yoke 26 having a central sleeve 26*a*. The latter is guided in a sleeve 10*a* extending from the top end of frame 10. Sleeve 10*a* is urged downwards by a spring arm 28 forming part of yoke 26. Sleeve 26*a* is in threaded engagement with mounting sleeve 24 in the container lid 4. Yoke 26 has two arms, the one of which, 26*b*, is rigid and protrudes laterally under the top portion 2 of the container wall. In the embodiment illustrated the free end of arm 26*b* is received in a recess surrounding opening 3. The other yoke arm 26*c* is at its free end shaped like a hairpin spring 27 also contacting the lower surface of said upper portion 2 of the container wall. Preferably most of the components of the integral units are made in a synthetic resin material, it obviously being necessary for yoke 26 to select a material yielding sufficient elasticity in spring portion 27**.

The mounting of the unit is carried out in the following way. First, control knob 23 and its guide sleeve 24 are turned loose and removed whereupon lid 4 can be lifted off. It is then possible to turn yoke 26 around its vertical axis. Suitably, the turning movement is through 90°. As the transverse dimension of opening 3 is greater in a direction perpendicular to the plane of the drawing than in that plane, when the turning movement has been completed, yoke 26 and the other parts of unit 1 may freely pass upwards through opening 3. Mounting of the unit is carried out in the reverse order.

Finally, it should again be emphasized that the arrangement shown in the drawing is only intended to illustrate the basic inventive concept which is that the means retaining the unit in its mounted position are at the top end thereof whereas the connection means at the foot end do not perform any locking action.

We claim:

1. A valve arrangement for a gravity discharge water toilet flush tank, said valve arrangement designed as an elongate, vertically disposed integral unit, comprising:

a water supply valve (16);

float means (11) disposed within the tank and operatively coupled to the supply valve for controlling the opening and closing thereof;

a flush valve (18);

means (**17*a*, 25) for sealing a lower end of said unit to a flush water outlet (6) of the tank, said means being slidable in a vertical direction but fixed in the horizontal direction; and yoke means detachably retaining the unit in its vertically sealed position, said yoke means (26) being located at an upper end of the unit and cooperating with an inner surface of a top wall (2**) of said tank which surrounds an opening (3) thereof covered by a tank lid (4).

2. An arrangement as claimed in claim 1, characterized in that retaining means (26) include a portion (27) contacting said wall portion inner surface with spring action.

3. A valve arrangement for a gravity discharge water toilet flush tank, comprising:

(a) an elongate, vertically oriented frame member (10);

(b) an inlet water valve (16) mounted to an upper portion of the frame member;

(c) a float (11) slidably mounted on said frame member;

(d) first control linkage means (14, 15) coupling the float to the inlet valve;

(e) a flush water outlet pipe (6) mounted in a bottom wall (5) of the tank;

(f) a guide sleeve (17) mounted on a lower portion of the frame member and including an outlet valve seat (19);

(g) means (25) for sealing a lower portion (17*a*) of the guide sleeve to the outlet pipe, said means being slidable in a vertical direction but fixed in a horizontal direction;

(h) an outlet valve (18) slidably disposed within the guide sleeve and cooperable with the valve seat;

(i) second control linkage means (20, 22) coupled to the outlet valve and extending through a mounting and access opening (3) in a top wall (2) of the tank; and (j) yoke means (26) detachably mounted within said access opening for retaining the frame member in position and for biasing the frame member downwardly to maintain the seal between the lower portion of the guide sleeve and the outlet pipe.

4. A valve arrangement as defined in claim 3, wherein the yoke means slidably engages and guides said upper portion of the frame member.

* * * * *